US007237417B2

(12) United States Patent
Wittig

(10) Patent No.: US 7,237,417 B2
(45) Date of Patent: Jul. 3, 2007

(54) ROLL PRESHAPING

(75) Inventor: Axel Wittig, Wangen im Allgäu (DE)

(73) Assignee: Müller Weingarten AG, Weingarten (DE)

( * ) Notice: Subject to any disclaimer, the term of this patent is extended or adjusted under 35 U.S.C. 154(b) by 0 days.

(21) Appl. No.: 11/060,630

(22) Filed: Feb. 17, 2005

(65) Prior Publication Data

US 2005/0183485 A1 Aug. 25, 2005

(30) Foreign Application Priority Data

Feb. 20, 2004 (DE) ..... 10 2004 008 800

(51) Int. Cl.
*B21D 7/02* (2006.01)
*B21D 43/10* (2006.01)

(52) U.S. Cl. ..... 72/214; 72/422

(58) Field of Classification Search ..... 72/214–215, 72/216, 191, 194, 197, 220, 250, 252, 419, 72/422

See application file for complete search history.

(56) References Cited

U.S. PATENT DOCUMENTS

| | | | | |
|---|---|---|---|---|
| 189,201 A * | 1/1877 | Douglass | 72/197 |
| 1,013,429 A * | 1/1912 | Nowak | 72/215 |
| 2,202,016 A * | 5/1940 | McCutcheon | 72/213 |
| 2,432,566 A * | 12/1947 | Findlater | 72/215 |
| 3,199,327 A * | 8/1965 | Krause | 72/215 |
| 3,338,081 A * | 8/1967 | Schiller | 72/252 |
| 3,505,849 A * | 4/1970 | Dietrich | 72/215 |
| 3,983,734 A * | 10/1976 | Walig | 72/214 |
| 4,109,358 A * | 4/1977 | Frohling et al. | 72/190 |

FOREIGN PATENT DOCUMENTS

| | | |
|---|---|---|
| DE | 100 48 312 | 4/2002 |
| FR | 2 750 351 | 1/1998 |
| GB | 2 069 883 | 9/1981 |
| WO | 03/039787 | 5/2003 |

* cited by examiner

*Primary Examiner*—Derris H. Banks
*Assistant Examiner*—Teresa M. Bonk
(74) *Attorney, Agent, or Firm*—Burr & Brown

(57) ABSTRACT

A preshaping method for massive forming processes is proposed in which a fixed blank is deformed by at least one roll moving continuously forward along a predetermined contour.

19 Claims, 5 Drawing Sheets

ROLL PRESHAPING

CROSS REFERENCE TO RELATED APPLICATION

This application claims the benefit of German Application No. 2004 008 800.4, filed Feb. 20, 2004, the entirety of which is incorporated herein by reference.

FIELD OF THE INVENTION

The invention relates to a method and a device for preshaping a blank in a massive forming process.

BACKGROUND OF THE INVENTION

In the process chain of die forging, an intermediate shape in relation to the final shape of the forged part is required. The result of the subsequent die forging is thus to be improved by an accumulation or reduction in mass at certain points of the workpiece. In order to obtain the intermediate shape, methods such as transverse rolling or stretch rolling, for example, are known.

Further methods are described in "Lehrbuch der Umformtechnik" [textbook of forming technology], Kurt Lange, Springer-Verlag 1974, page 46.

Both transverse rolling and stretch rolling permit optimum geometric adaptation of the mass distribution on the intermediately shaped part to the requirements for the die forging of elongated parts. The excess material in the final shape is thereby minimized and uniformly distributed and permits low-flash die forging. Due to the adaptation of the rolled intermediate shape to the final shape of the finish-forged part, constant forming forces and thus minimum tolerances of the finished parts in the press direction are ensured. In addition, relative movements in the pressure contact zone between workpiece and impression are reduced and thus the wear of the dies is reduced. By the use of preshaping methods preceding the die forging, the use of material can be reduced by up to a third.

In massive forming, a trend toward a higher and higher number of strokes has recently been detected. This is achieved in particular through the use of modern crank presses having fully automatic workpiece transfer for the die forging. The known preshaping methods, in particular transverse rolling and stretch rolling, have the disadvantage that they can only be integrated with difficulty in a fully automatic forging process with automatic workpiece transport. The reasons for this are the relatively high cycle times during the transverse or stretch rolling, and the partly unsuitable position of the workpiece at the end of the rolling operation for an automated production process.

A further disadvantage is the complicated design of the preshaping device and the associated high costs.

SUMMARY OF THE INVENTION

The object of the invention is to develop a method and a device for preshaping a forged part, which method is cost-effective with high productivity and can be integrated in the transfer of a forging press.

The central idea of the invention is a method in which a fixed blank is deformed by at least one roll, preferably two rolls, moving continuously forward along a predetermined contour. The feed movement of the contour roll is effected by a linear drive.

The path of the contour rolls during the feed is preferably determined by two profile inserts, the profile of which corresponds to the negative shape of the blank to be preshaped. Due to the feed movement and due to the shape of the contour rolls, the blank is formed by the contour of the profile inserts. In order to obtain, for example, a blank preshaped in a rotationally symmetrical manner as a final result of the "roll preshaping", the contour rolls must be designed with the appropriate radius. As an alternative to this, it is also possible to use a contour roll only on one side. In this case, the blank is supported on the opposite side by a fixed stop during the preshaping.

Also conceivable is a solution in which the contour rolls are supported on straight plates on the side remote from the blank, these plates varying the distance between the plates and the blank axis by means of servomotors in such a way that the blank is appropriately preshaped. The actuators used may be, for example, servomotors or also hydraulic motors.

The blank is fixed with turning tongs. After a forming pass, the turning tongs and thus the partly formed blank are turned by 90°. The rolling operation is repeated in this position. As a result, the blank has attained an approximately rotationally symmetrical intermediate shape. It is also conceivable to run more than two rolling cycles with correspondingly smaller turning angle in order to improve the preshaping result. Of course, if the blank is made of a flat bar for example, just one forming pass can also produce the required intermediate shape.

During the rolling operation, the blank is held by the turning tongs and is supported radially from below by, for example, two ejector pins. A further function of the turning tongs is to compensate for elongation or stretching caused by the preshaping. At the end of the preshaping operation, the profile inserts are designed in such a way that the contour rolls move out of the forming region. The ejector pins now lift the preshaped blank onto the workpiece transport plane. The blank is then gripped by the transfer system of the forging press and is transported through the corresponding forming station.

The device according to the invention for this method can be positioned as an independent forming unit or can also be positioned in the column region of the forging press. As a result, the device for the roll preshaping can be integrated in the existing press transfer device in a cost-effective manner.

An independent solution in which the proposed device is placed in front of the forging press with separate feed device is likewise possible. The proposed preshaping method can be used both with and without additional heat treatment. In addition, the method is suitable for different materials, such as steel or aluminum for example.

In the case of high forming ratios during the preshaping, a plurality of devices according to the invention may also be operated arranged one above the other. The forming ratio increases in accordance with the number of devices used. The yield with a plurality of devices arranged one above the other is the same as when using only one device. As already mentioned, a linear force in the direction of the blank axis is necessary in order to press the contour rolls through between the blank and the profile inserts. This linear force is preferably produced by a hydraulic drive, but force transmission by a mechanical drive is also possible.

The force transmission from the drive to the contour rolls must be effected in such a way that the latter are freely movable in a plane perpendicular to the direction of movement in order to be able to follow the contour of the profile inserts. This is achieved by a fork head on which two arms are mounted in an articulated and scissors-like manner. The two contour rolls are rotatably mounted on these two arms. The arms on which the contour rolls are mounted may be additionally acted upon by a spring force in such a way that the contour rolls bear reliably against the contour during the advance and withdrawal. During the preshaping, the blank is supported by a stop plate against the feed direction or force.

In order to improve the forming result, the device according to the invention can be equipped with a guide sleeve which stabilizes the blank during the forming operation. This is achieved by a sleeve which encloses the blank up to right in front of the region of the forming and is carried along by the articulated arms in the direction of the blank axis against a spring force. As a result, bulging or inclination of the blank due to the forming is prevented.

In order to be able to absorb the reaction force produced by the forming force, the profile inserts are fixed in a plane perpendicular to the blank axis. This may be effected by a mechanical stop, but other design solutions, such as, for example, a dimensionally stable frame which encloses the two profile inserts, are also possible.

The profile inserts, the stop plate and the frame thus form a device or a tool for the roll preshaping. This tool is restrained on a fixed table by known methods, such as with wedges or clamps for example, in such a way that the tool can easily be changed. Of course, it is also possible to exchange only the profile inserts. A mechanical stop in and against the feed direction of the hydraulic cylinder on the fixed table is appropriate.

Further advantages and details of the invention follow from the description and the figures of the exemplary embodiment.

DETAILED DESCRIPTION OF THE INVENTION

Figure 1:
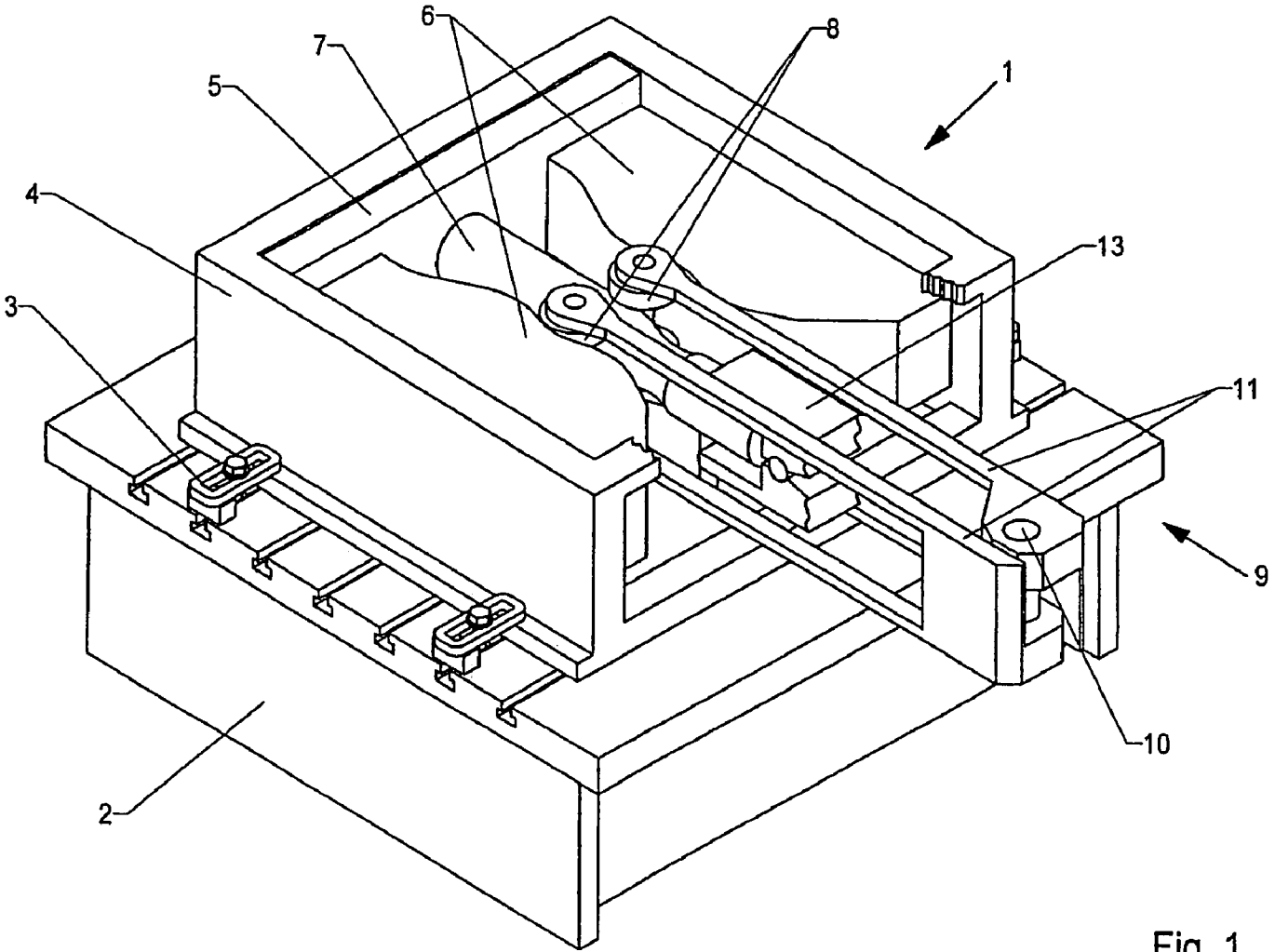
FIG. 1 shows a device for roll preshaping, in an isometric view.

A device 1 for roll preshaping is shown in FIG. 1. A table 2 can be seen, on which a fixed, flexurally rigid frame 4 is fastened by means of clamping shoes 3. Two profile inserts 6 are fastened to the side walls of this frame 4. On the side directed toward the center, these profile inserts have a contour which is matched to the final contour of the preshaped blank 7. The blank 7 is supported on one side on a stop plate 5, which is likewise fastened to the frame 4. At the other end, the blank is held by turning tongs 13.

Figure 5:
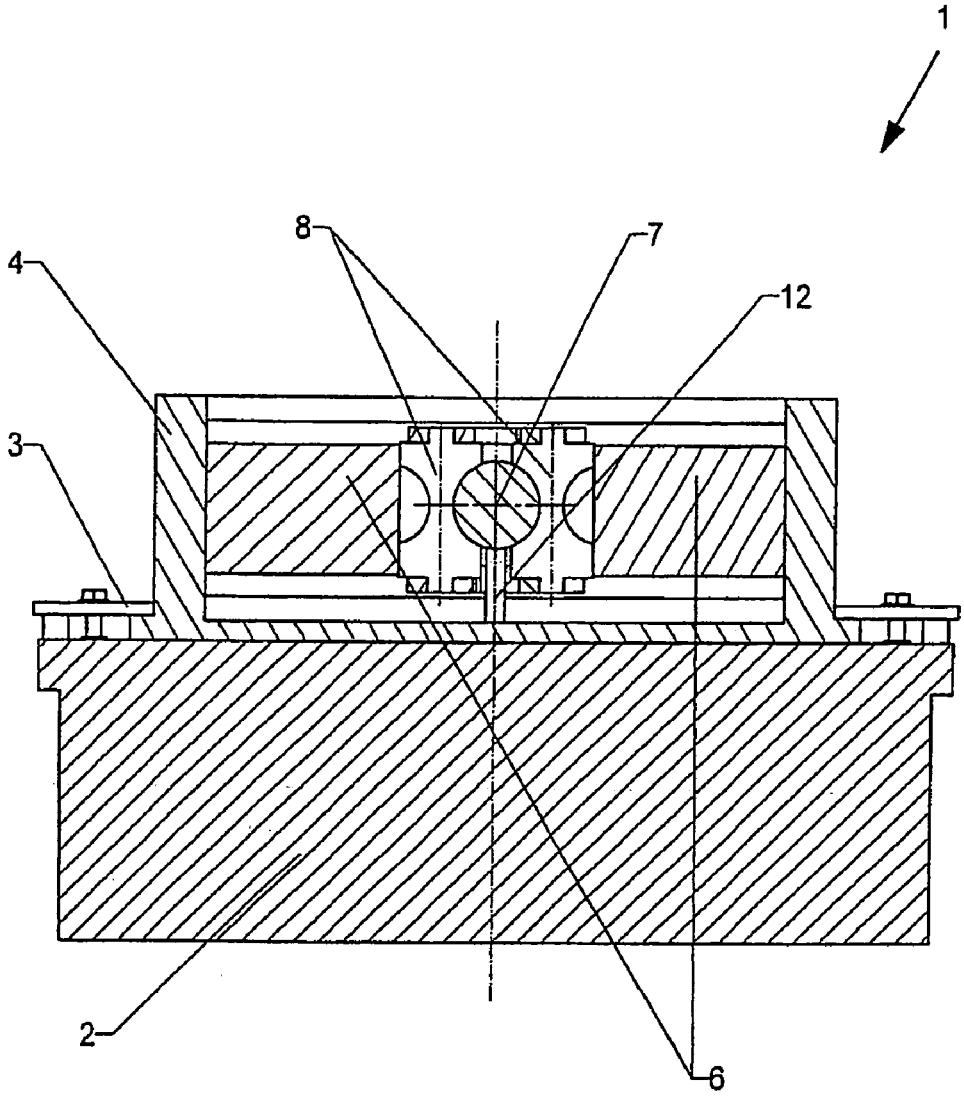
FIG. 5 shows the device for roll preshaping in a sectional illustration.

A device 1 for roll preshaping is shown in section in FIG. 5. Ejector pins 12 can be seen, which support the blank 7 from below during the preshaping process. Located between the profile attachments 6 and the blank 7 are two contour rolls 8 which, by means of a drive (not shown), for example a hydraulic cylinder, are moved along the outer contour of the profile inserts 6 in the forming direction 9 via a drive linkage 11. As a result, the outer contour is pressed into the blank 7 via the contour rolls 8 deforming the blank 7 such that the blank 7 elongates. The elongation effectively lengthens the blank 7 while the contour rolls are moved in the forming direction 9. The turning tongs 13 compensate for the elongation occurring by moving in a direction opposite to the forming direction 9. At the start and at the end, the profile inserts 6 are designed with a contour diverging from the blank 7, so that the contour rolls 8 move away from the blank 7 at the start and at the end of the preshaping operation. The contour rolls 8 are pressed against the contour of the profile inserts 6, for example by a spring force which acts on the arms of the drive linkage 11. The drive linkage 11 essentially comprises 2 arms which are mounted at a common pivot 10.

As soon as the contour rolls 8 have moved away from the preshaped blank 7 at the end of the preshaping process, the blank 7 can be lifted by the ejector pins 12 and transported by an automatic transfer system, for example into a die forging press.

Optionally, by rotating the turning tongs 13 and the blank 7 about its longitudinal axis, the preshaping operation can be repeated against the direction 9. An approximately rotationally symmetrical preshaped blank 7 can be produced by repeating the roll preshaping several times.

Figure 2:
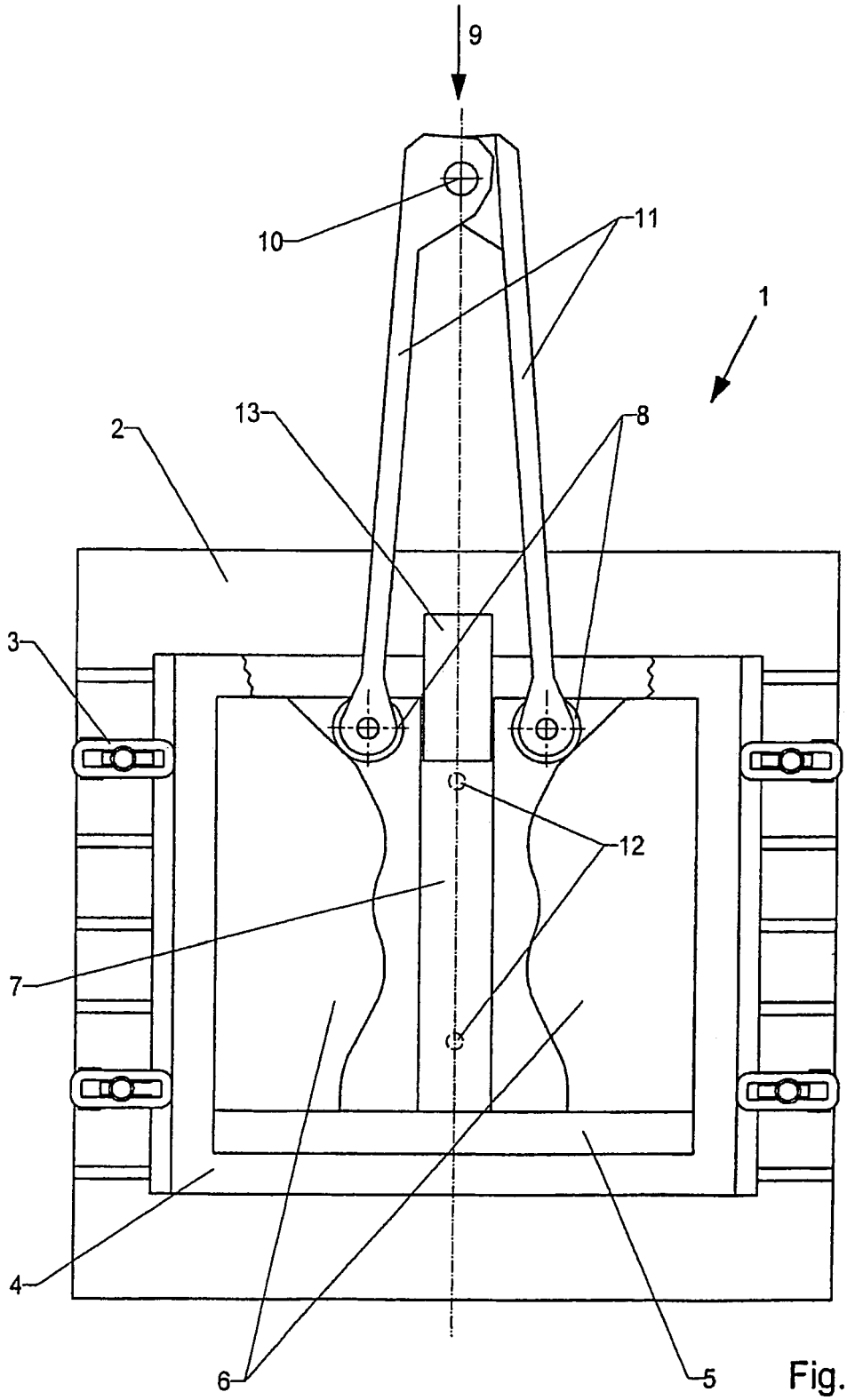
FIG. 2 shows a plan view at the start of the roll preshaping.
Figure 3:
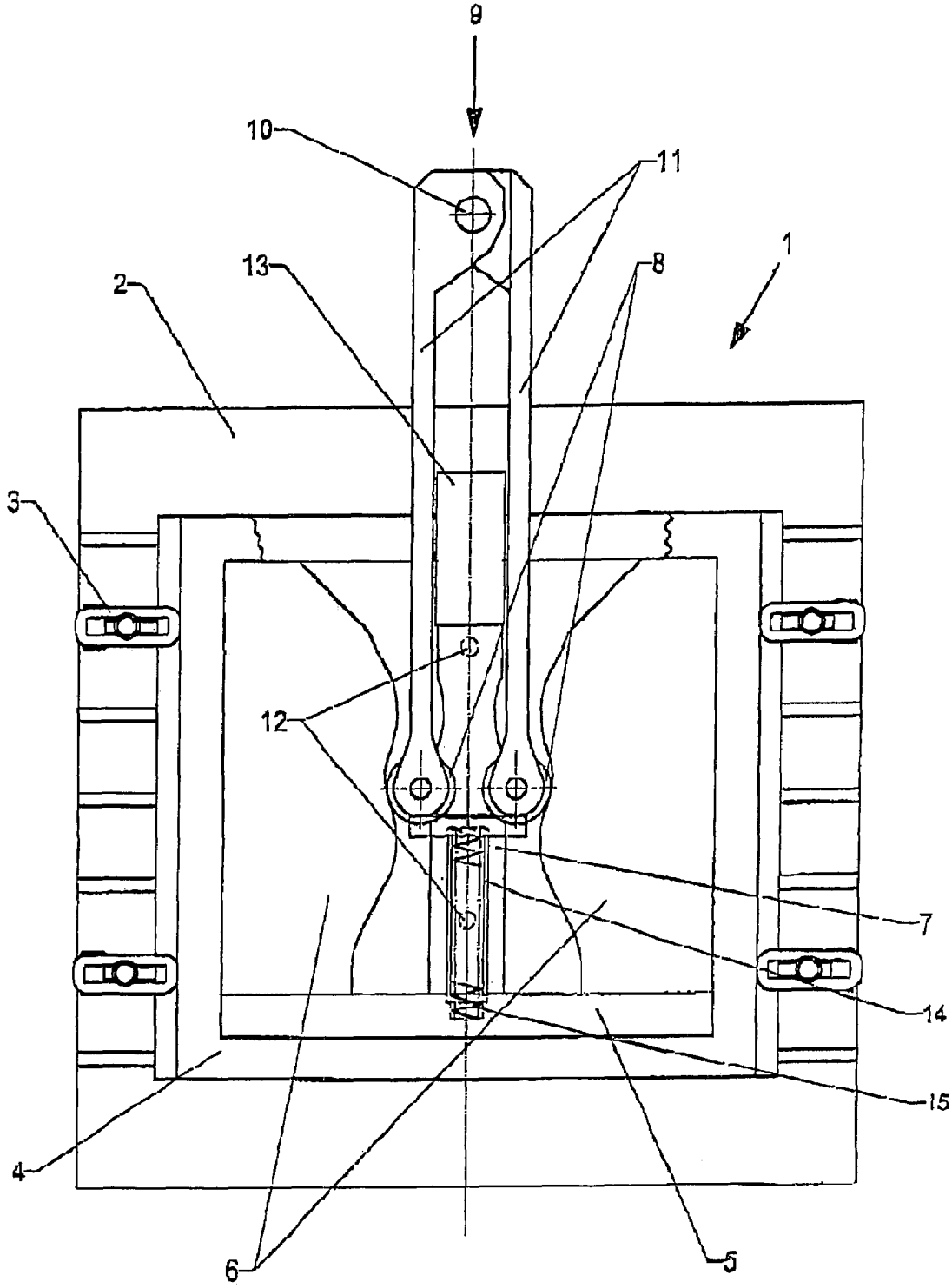
FIG. 3 shows a plan view during the roll preshaping.
Figure 4:
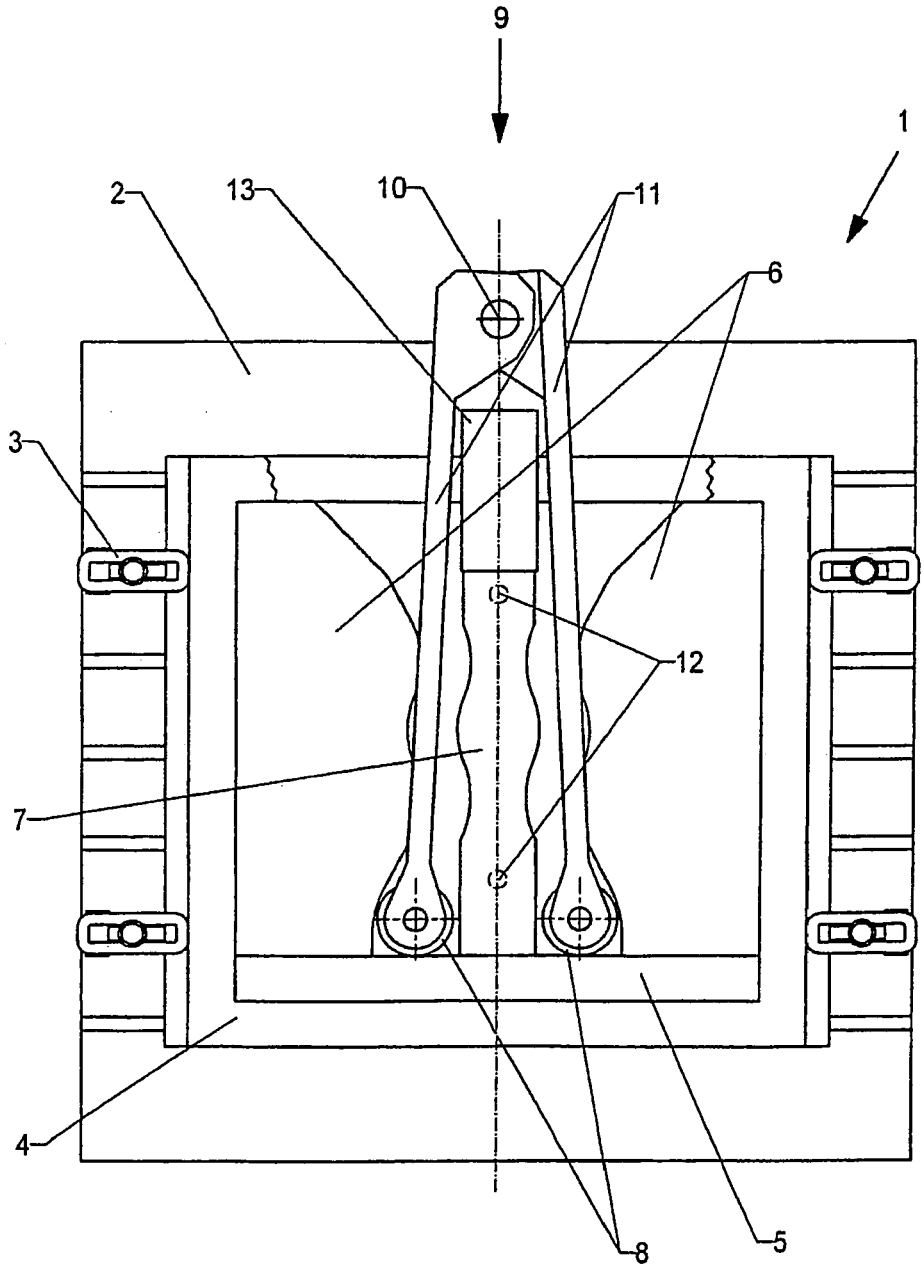
FIG. 4 shows a plan view at the end of the roll preshaping.

Different preshaping stages are shown in FIGS. 2, 3 and 4. The start of the preshaping process can be seen in FIG. 2. The blank 7 is not yet formed. The contour rolls 8 are still located in the entry region of the outer contour of the profile inserts 6.

In FIG. 3, the contour rolls 8 have covered about half the forming distance, and the resulting proportionate forming of the blank 7 can clearly be seen.

The device 1 can be equipped with a guide sleeve 14 to improve the forming result. The guide sleeve 14 encloses the blank 7 up to a point right in front of the contour rolls 8 to stabilize the blank 7 and to prevent bulging or inclination of the blank 7 during the forming operation. The sleeve 14 is carried along by the device linkage 11 in the direction 9 of the blank 7 axis against a spring force 15.

In FIG. 4, the contour rolls 8 have already moved out of the region in which forming takes place and allow the preshaped blank 7 to be lifted by the ejector pins 12.

The invention is not restricted to the exemplary embodiment shown and described. It also comprises all developments by the person skilled in the art within the scope of the idea according to the invention.

The invention claimed is:

1. A method of producing a formed part from a blank for subsequent massive forming comprising:

(a) holding the blank within a frame with turning tongs;

(b) providing at least one movable contour roll in direct contact with the blank;

(c) providing at least one fixed profile insert directly contacting the movable contour roll;

(d) displacing the contour roll in a direction along the longitudinal axis of the blank;

(e) plastically deforming the blank in a continuously progressive manner to provide the formed part;

(f) displacing the turning tongs in a direction opposite to the contour roll displacement while plastically deforming the blank;

(g) rotating the formed part about its longitudinal axis; and (h) repeating steps (d), (e) and (f) at least once to increase the forming ratio of the formed part.

2. The method as claimed in claim 1, further comprising heating the blank at least prior to step (d).

3. The method as claimed in claim 2, further comprising feeding the formed part into a forging process in a fully automatic manner without further heat treatment.

4. The method as claimed in claim 1, wherein the formed part has a predetermined cross-sectional shape.

5. A device for producing a formed part from a blank for subsequent massive forming comprising:

at least one movable contour roll in direct contact with the blank for producing the formed part along a path in the longitudinal and transverse directions of the formed part;

at least one fixed profile insert directly contacting the movable contour roll; and turning tongs for rotating one of the blank and the formed part about its longitudinal axis, wherein the turning tongs move in a direction opposite to a forming pass direction of the movable contour roll during a forming pass.

6. The device as claimed in claim 5, further comprising linear drive means for displacing the contour roll in the direction of the longitudinal axis of the blank.

7. The device as claimed in claim 5, wherein the outer contour of the fixed profile insert corresponds to a predetermined cross-sectional shape of the formed part.

8. The device as claimed in claim 5, further comprising:

at least two contour rolls; and at least two fixed profile inserts.

9. The device as claimed in claim 5, further comprising a plurality of servomotors used to control a distance between the contour roll and the longitudinal axis of the formed part.

10. The device as claimed in claim 9, further comprising at least one flat plate supporting the contour roll and servomotors.

11. The device as claimed in claim 8, further comprising:

a linear drive; and at least two arms connected to the linear drive at a common pivot, the arms crossing one another and being rotatably mounted to the contour rolls.

12. The device as claimed in claim 11, further comprising: a spring operatively connected to the arms, the spring forcing the arms onto the fixed profile inserts.

13. The device as claimed in claim 6, further comprising at least one of a hydraulic cylinder and a lever mechanism for effecting the linear drive.

14. The device as claimed in claim 8, further comprising a stop plate for supporting the blank against the contour rolls during forming.

15. The device as claimed in claim 5, further comprising a sleeve for guiding the blank during forming, the sleeve being movable together with the contour roll along the longitudinal axis of the formed part.

16. The device as claimed in claim 14, further comprising a closed frame enclosing the fixed profile inserts and the stop plate.

17. The device as claimed in claim 5, further comprising at least one ejector for supporting and lifting the blank before and after forming.

18. The device as claimed in claim 5, further comprising a common linear device for driving a plurality of preshaping devices.

19. A device for producing a formed part from a blank for subsequent massive forming comprising:

a frame having a closed end and an open end located opposite the closed end;

a stop plate mounted at the closed end of the frame, the stop plate being arranged such that it supports a first end of one of the blank and the formed part;

at least one movable contour roll in direct contact with the blank for producing the formed part along a path in the longitudinal and transverse directions of the formed part;

at least one fixed profile insert directly contacting the movable contour roll, the fixed profile insert being mounted within the frame; and turning tongs extending out of the open end of the frame for rotating and supporting a second end of one of the blank and the formed part about its longitudinal axis, wherein the turning tongs move in a direction opposite to a forming pass direction of the movable contour roll during a forming pass.

* * * * *